US008820552B2

(12) United States Patent
Pleyer

(10) Patent No.: US 8,820,552 B2
(45) Date of Patent: Sep. 2, 2014

(54) LOCKING SLEEVE WITH A RETAINING DEVICE FOR FASTENING A CLOSURE DEVICE AND CLOSURE DEVICE

(75) Inventor: Juergen Pleyer, Marburg (DE)

(73) Assignee: Aptar France SAS, Le Neubourg (FR)

( * ) Notice: Subject to any disclaimer, the term of this patent is extended or adjusted under 35 U.S.C. 154(b) by 1504 days.

(21) Appl. No.: 11/523,834

(22) Filed: Sep. 19, 2006

(65) Prior Publication Data

US 2007/0068972 A1 Mar. 29, 2007

(30) Foreign Application Priority Data

Sep. 19, 2005 (DE) ..... 10 2005 044 746

(51) Int. Cl.
*B65D 45/32* (2006.01)
*B67B 1/00* (2006.01)

(52) U.S. Cl.
USPC ..... 215/272; 215/274; 222/321.7; 222/321.1; 222/153.09

(58) Field of Classification Search
USPC ..... 215/272, 274; 222/321.7, 321.8, 222/153.09, 153.1, 153.01, 321.9, 321.1
See application file for complete search history.

(56) References Cited

U.S. PATENT DOCUMENTS

| | | | | |
|---|---|---|---|---|
| 5,562,219 | A * | 10/1996 | de Pous et al. | 215/274 |
| 6,253,941 | B1 | 7/2001 | VanBrocklin et al. | |
| 6,276,544 | B1 * | 8/2001 | Battegazzore | 215/252 |
| 6,588,614 | B2 * | 7/2003 | Neuner | 215/40 |
| 6,772,893 | B2 * | 8/2004 | Pares Montaner et al. | 215/274 |
| 6,776,311 | B2 * | 8/2004 | Ackermann | 222/321.7 |
| 2002/0125270 | A1 | 9/2002 | De Pous et al. | |

FOREIGN PATENT DOCUMENTS

| | | |
|---|---|---|
| EP | 0 988 237 | 12/1998 |
| EP | 1 270 434 A1 | 1/2003 |
| WO | WO 98/55370 | 12/1998 |
| WO | WO 2007/042701 A1 | 4/2007 |

OTHER PUBLICATIONS

European Patent Office Search Report for Counterpart Patent No. EP 06019267.1-1268 Jan. 23, 2008.

* cited by examiner

*Primary Examiner* — Anthony Stashick
*Assistant Examiner* — Ernesto Grano
(74) *Attorney, Agent, or Firm* — Blakely, Sokoloff, Taylor & Zafman LLP

(57) ABSTRACT

A locking sleeve (17) is described for fastening a closure device (11) on a container opening comprising a sleeve body which is at least provided with a slip-on collar at its lower end region, wherein the slip-on collar has an inner circumferential surface (21) for enveloping coverage of an outer circumferential surface (25) of the closure device, this inner circumferential surface being provided with a retaining device (22) at least in an area of overlap with the outer circumferential surface and the retaining device comprising a plurality of retaining units (23) which are radially distributed over the circumference of the inner circumferential surface.

5 Claims, 2 Drawing Sheets

LOCKING SLEEVE WITH A RETAINING DEVICE FOR FASTENING A CLOSURE DEVICE AND CLOSURE DEVICE

CROSS-REFERENCE TO RELATED APPLICATIONS

The present patent application claims priority from German Patent Application No. 10 2005 044 746.5, filed on Sep. 19, 2005.

BACKGROUND OF THE INVENTION

1). Field of the Invention

The present invention relates to a locking sleeve for fastening a closure device according to the preamble of claim 1 and a closure device for closing a container opening, comprising a closure stopper made of plastic and a locking sleeve of this type.

2). Discussion of Related Art

Closure devices of the type specified initially can in principle be used wherever it is necessary to secure a closure stopper made of plastic in its relative positioning with respect to a part which receives the closure stopper. Particular fields of application are obtained according to the construction of the closure stopper. For example, the closure stopper can be used to close a bottle, the locking sleeve being used to secure the position of the closure stopper in the bottle opening.

A particular field of application for the closure device is obtained during closure of a perfume bottle, the closure stopper usually being embodied as an atomizer which is disposed in the bottle opening.

A closure device used in this manner is known from U.S. Pat. No. 6,253,941 B1, comprising a closure stopper embodied as an atomizer device, which comprises a flange portion as a component of the atomizer device for arranging at the front end of the bottle opening. In its fixing region surrounding the upper edge of the bottle, the closure stopper has a locating flange which encloses the bottle edge and thus defines the position of the closure stopper or the atomizer device in the bottle opening. A locking sleeve is arranged coaxially on the closure stopper for locking the closure stopper in the aforesaid position, this sleeve being axially displaceable with respect to the closure stopper until a stop collar of the locking sleeve comes to rest against a stop face of the atomizer device when this stopper is positioned in the bottle opening. In its locking position, the locking sleeve provided with a retaining device having annular embossed grooves arranged on its inner circumferential surface is located in engagement with the outer circumferential surface of the locating flange of the closure stopper or the atomizer device. In this position, the locating engagement of the locating flange is ensured. As a result of the engagement between the retaining device on the inner surface of the metal locking sleeve with the plastic material of the closure stopper or the locating flange, it is also ensured that the locking sleeve could only be pulled from the bottle neck with a force which does not arise during use of the perfume bottle, that is for example, when pulling off a closure cap which has been slid onto the locking sleeve. It is also effectively prevented that any unintentional release of the locking sleeve from engagement with the closure stopper or the atomizer device can take place when pulling off the closure cap, which could endanger the function of the perfume bottle or the atomizer device.

In the known closure device, the retaining device is formed on the inside of the locking sleeve by annular indentations in the inner wall of the locking sleeve. As a result of the annular retaining device, an effective retaining effect against a withdrawal force which separates the locking sleeve from the closure stopper is certainly obtained. However, the locking sleeve can easily rotate on the closure stopper or the locating flange so that the user of the perfume bottle could have the impression that the atomizer device is inadequately secured on the bottle. The value of the product, that is the perfume bottle, is hereby reduced in the eyes of the user. In addition, it is fundamentally not possible to use the known closure device consisting of a plastic closure stopper and metal locking sleeve in cases in which a relative rotational positioning of the parts relative to one another is to be ensured.

SUMMARY OF THE INVENTION

It is the object of the present invention to propose a closure device of the type specified initially which, on the one hand, when this closure device is used on a perfume bottle or a similar luxury article, enhances the impression of value for the consumer. In addition, it is the object to propose a closure device which, in addition to the aforesaid, also allows further possible applications, in particular generally in the area of fastening technology.

To achieve this object, the locking device according to the invention has the features of claim 1 and the closure device according to the invention has the features of claim 9.

The locking sleeve according to the invention comprises a sleeve body which is at least provided with a slip-on collar at its lower end region, wherein the slip-on collar has an inner circumferential surface for enveloping coverage of the outer circumferential surface of the closure device, this inner circumferential surface being provided with a retaining device at least in an area of overlap with the outer circumferential surface. The retaining devices comprise a plurality of retaining units which are radially distributed over the circumference of the inner circumferential surface.

As a result of the radially distributed arrangement of the retaining units, regions which allow engagement with the plastic material of the closure stopper and regions which allow no engagement are obtained in a radially alternating manner on the inner surface of the sleeve. Consequently, corresponding alternating frictional relationships are obtained in the radial direction so that in the closure device according to the invention, a resistance against a relative twisting of the locking sleeve with respect to the closure stopper is achieved as a result of the engagement.

In an advantageous embodiment of the locking sleeve, the retaining units comprise linear indentations which are arranged one after the other in the axial direction and extend over a partial circumference of the circumferential surface. In the case of a press fit between an outer circumferential surface of a flange portion of the closure stopper, which externally surrounds the container opening and the inner surface of the sleeve, these indentations or grooves extending in the circumferential direction ensure engagement of the plastic material in the indentations as a result of the creeping capability of the plastic material of the closure stopper so that both a form resistance against pulling of the locking sleeve from the closure stopper and also a radial turning resistance is achieved which prevents a relative twisting of the locking sleeve with respect to the closure stopper.

If, furthermore, the retaining units comprise linear indentations which each run parallel to one another and are distributed equidistantly over a partial circumference of the circumferential surface, it is particularly simple to produce the retaining units formed on the inner circumferential surface of the locking sleeve by a rolling tool which produces the desired indentations with suitable profiling on the inner circumferential surface of the locking sleeve.

In an alternative embodiment of the locking sleeve, the retaining units are embodied as webs which run axially on the circumferential surface, which extend over a partial region of the region of overlap. Firstly, these webs also act as radial securing against twisting as a result of the engagement of the webs into the plastic material of the closure stopper. Secondly, as a result of the reduced length of the webs compared with the region of overlap, a form resistance is created in the direction of an axially acting pulling force.

If the retaining units are formed by webs which run axially on the circumferential surface, which each comprise at least two web units which are arranged axially one after the other and which are separated from one another by an indentation, the webs can also extend over the region of overlap since in this case, the form resistance counteracting an axial pulling force is created by the indentations which separate respectively two web units from one another.

In an embodiment of the locking sleeve with webs which run parallel to one another and are distributed equidistantly over the circumference of the circumferential surface, it is firstly possible to produce the locking sleeve using a regularly constructed tool and secondly, the radially equidistant distribution of the webs at the same time allows a centering effect which makes it easier to join together the locking sleeve and the closure stopper.

In a further embodiment of the locking sleeve, the retaining units are formed by indentations in an inner collar formed by folding at the lower edge of the sleeve body.

It is particularly simple to produce a locking sleeve of this type if the sleeve body has an edge strip with reduced wall thickness for forming the fold at the lower edge.

The closure device according to the invention for closing a container opening comprises a closure stopper made of plastic and a locking sleeve according to the type described previously, the locking sleeve comprising a more rigid material than the closure stopper.

The closure device according to the invention can be used particularly advantageously in combination with a perfume bottle or the like if the closure stopper is embodied as an atomizer device. In this case, in order to achieve a desired value of the product, it is particularly advantageous if the locking sleeve is made of metal.

BRIEF DESCRIPTION OF THE DRAWINGS

Advantageous embodiments of the closure device are explained hereinafter with reference to the drawings.

In the figures.

DETAILED DESCRIPTION OF THE INVENTION

Figure 1:
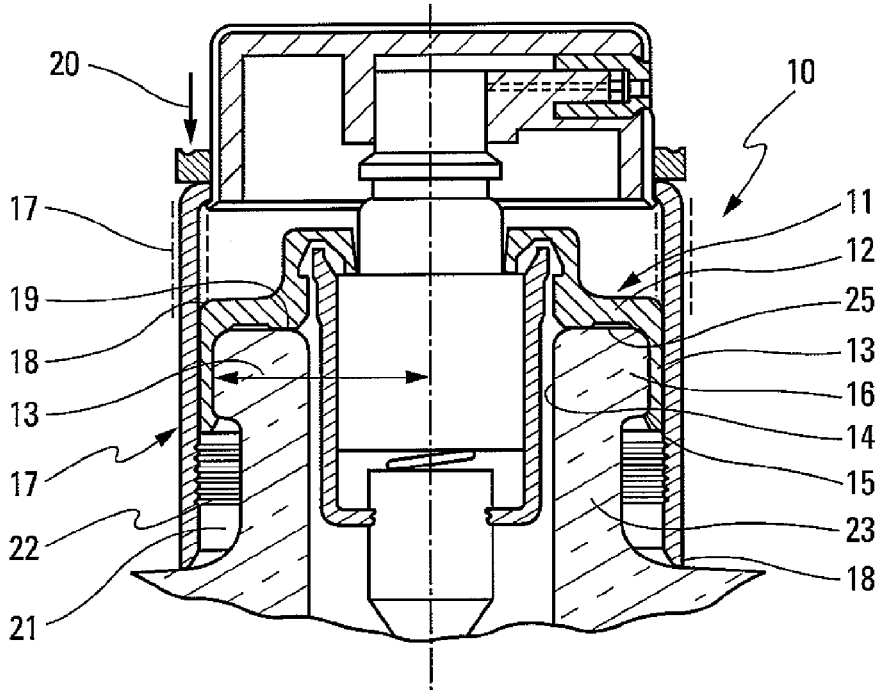
FIG. 1 shows a locking device arranged on a bottle opening in the locking position.

FIG. 1 shows a closure device 10 arranged on a glass bottle, for example, a perfume bottle. The closure device comprises a closure stopper 11 which, in the case of the present exemplary embodiment is embodied as an atomizer device which has a fastening device embodied as a locating flange 12 at its upper end, which embraces a bottle edge 14 with locating tabs 13 distributed over its circumference. The locating flange 12 or the locating tabs 13 are formed from a flexibly yielding plastic material and have locating lugs 15 at their free ends which, in the arrangement of the locating flange 12 on the bottle opening in the manner shown in FIG. 1, latch in place behind the lower edge of an annular bead 16 formed on the bottle edge 14 in the manner of a snap-fit connection. To secure the locating flange 12 in the position shown in FIG. 1, a metal locking sleeve 17 is combined with the locating flange 12 or the closure stopper 11 which, in its mounting configuration which differs from the diagram in FIG. 1, abuts with its lower edge 18 against a mounting shoulder 19 of the locating flange 12, as shown by the dashed line in FIG. 1.

For securing the position of the locating flange 12 shown in FIG. 1, the locking sleeve 17 is transferred from this mounting position into its locking position shown in FIG. 1 by means of a joining force 20 indicated in FIG. 1.

Figure 2:
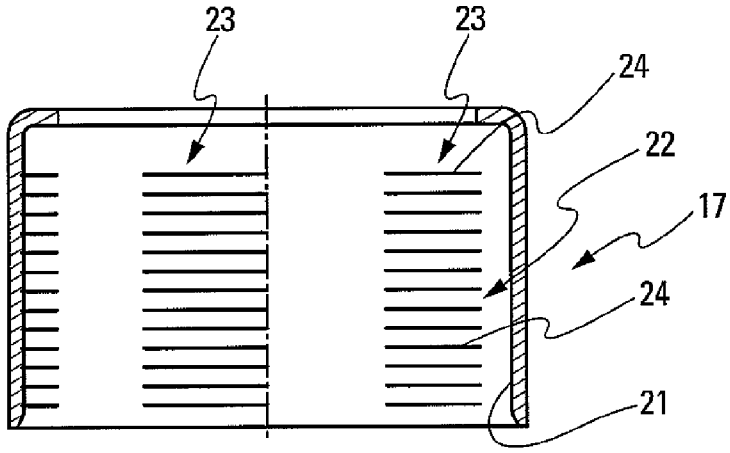
FIG. 2 shows a locking sleeve in a first embodiment.
Figure 3:
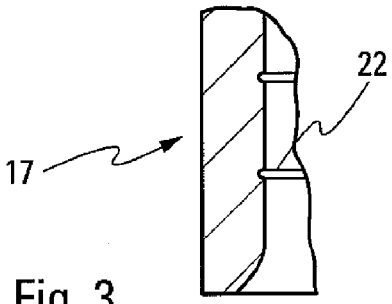
FIG. 3 shows an enlarged partial view of the locking sleeve shown in FIG. 1.

As shown in FIG. 2, on its inner surface 21 formed by the inner circumferential surface, the locking sleeve 17 has a retaining device 22 which comprises retaining units 23 distributed radially over the circumference, and which in the present case each extend axially. The individual retaining units 23 consist of linear indentations or grooves 24 arranged one after the other in the axial direction, as shown in enlarged view in FIG. 3, and which extend in the circumferential direction. In the exemplary embodiment shown in FIG. 2, six retaining units 23 are distributed radially over the circumference and arranged equidistantly. In the case of a press fit between an engaging circumferential surface 25 of the locating flange 12 formed by the outer circumferential surface and the inner surface 21 of the sleeve, the plastic material engages in the grooves 24 as a result of the creeping capability of the plastic material of the closure stopper 11 or the locating flange 14 so that pulling force acting against the joining force 20 must overcome the correspondingly formed retaining force to remove the locking sleeve 17.

As a result of the radially spaced arrangement of the retaining units 23, a type of toothed structure of the locking sleeve 17 with the closure stopper 17 or the locating flange 12 is obtained in the radial direction so that a relative twisting of the locking sleeve with respect to the closure stopper 11 is prevented or the correspondingly formed frictional force must first be overcome to execute any twisting.

Figure 5:
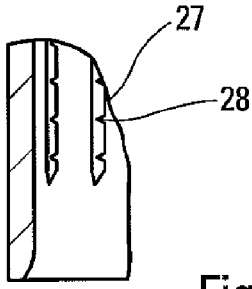
FIG. 5 shows an enlarged partial view of the locking sleeve shown in FIG. 4.
Figure 4:
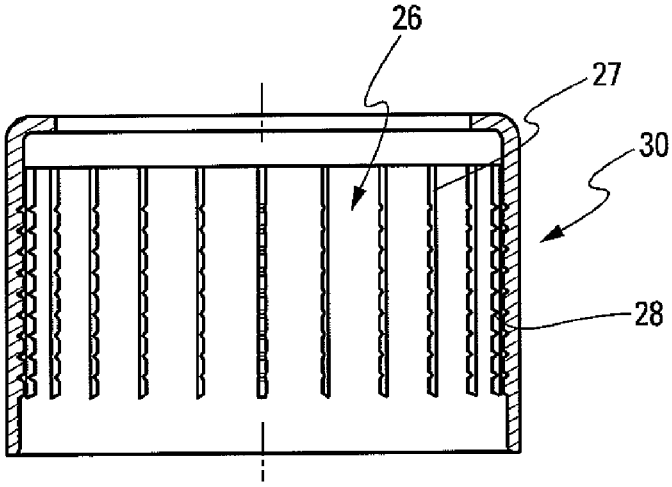
FIG. 4 shows a locking sleeve in a further embodiment.

FIG. 4 shows a locking sleeve 30 comprising a retaining device 26 which, according to the present exemplary embodiment, comprises a total of twenty four retaining units 27 distributed radially over the inner surface 21 of the sleeve, each being embodied as axially extending ribbed webs. In addition, the retaining devices or ribbed webs 27 each have web notches 28 which are arranged continuously and spaced apart from one another in the axial direction, as shown in FIG. 5. The web notches 28 serve predominantly to produce a retaining force which acts against the pulling force and the ribbed webs 27 primarily prevent a relative twisting between the locking sleeve 30 and the closure stopper 11 or the locating flange 12 as a result of their engagement in the plastic material of the closure stopper 11 or the locating flange 12.

Figure 6:
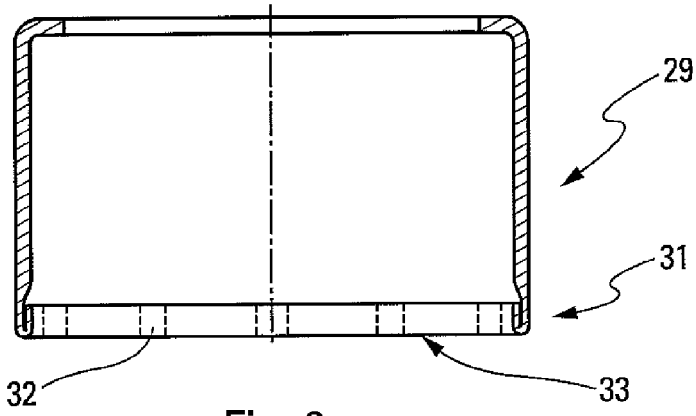
FIG. 6 shows a further embodiment of a locking sleeve.

FIG. 6 shows a locking sleeve 29 which is provided with an edge fold 31 at its lower edge to form an inner collar 33. As shown in particular in an enlarged partial view in FIG. 6, the edge fold 31 is provided in a thinned lower edge region of the locking sleeve 29 so that the double arrangement of the sleeve wall in the area of the edge fold 31 is not doubled but merely exceeds the other wall thickness of the locking sleeve by a smaller amount than the wall thickness. The collar 33 forms a retaining device which acts in the axial direction. If, as is indicated by the dashed line in FIG. 6, recesses 32 are provided in the collar 33, these being distributed radially over the collar 33, a retaining action is also achieved in the radial direction.

What is claimed:

1. A locking sleeve for fastening a closure stopper on a container opening, the sleeve comprising a sleeve body having an inner circumferential surface for enveloping coverage of an outer circumferential surface of the closure stopper, the inner circumferential surface being provided with a retaining device at least in an area of overlap with the outer circumferential surface of the locating flange of the closure stopper, wherein the retaining device comprises at least three retaining units which are continuously and radially distributed over the circumference of the inner circumferential surface of the locking sleeve, wherein the retaining units are formed by ribbed webs having web notches which are spaced continuously and apart from one another in an axial direction on the circumferential surface on the locking sleeve, wherein each retaining unit comprises at least three linear web units separated by at least two web notches, and the ribbed webs and web notches of the locking sleeve are located, and engage, the locating flange of the closure stopper in the area of overlap with the outer circumferential surface of the closure stopper.

2. The locking sleeve according to claim 1, wherein the webs run parallel to one another and are distributed equidistantly over the circumference of the circumferential surface.

3. A closure device for closing a container opening, in particular a bottle opening, comprising a closure stopper and a locking sleeve for fixing the closure stopper on the container opening, wherein, for fixing on the container opening, the closure stopper has a locating flange which externally surrounds the container opening, and the locking sleeve comprises a more rigid material than the locating flange of the closure stopper and a sleeve body having an inner circumferential surface for enveloping coverage of an outer circumferential surface of the closure stopper, the inner circumferential surface being provided with a retaining device at least in an area of overlap with the outer circumferential surface of the locating flange of the closure stopper, wherein the retaining device comprises at least three retaining units which are continuously and radially distributed over the circumference of the inner circumferential surface of the locking sleeve, wherein the retaining units are formed by ribbed webs having web notches which are spaced continuously and apart from one another in an axial direction on the circumferential surface of the locking sleeve of the retaining device, wherein each retaining unit comprises at least three linear web units separated by at least two web notches, and the ribbed webs and web notches of the locking sleeve are located, and engage, the locating flange of the closure stopper in the area of overlap with the outer circumferential surface of the closure stopper.

4. The closure device according to claim 3, wherein the closure stopper is embodied as an atomizer device.

5. The closure device according to claim 3, wherein the locking sleeve is made of metal.

* * * * *